United States Patent [19]

Mui et al.

[11] Patent Number: 4,782,735

[45] Date of Patent: Nov. 8, 1988

[54] BULLETPROOF PROTECTION APPARATUS

[76] Inventors: Paul Mui; Rosa Y. M. Tso, both of 3218 Quintara St., San Francisco, Calif. 94116

[21] Appl. No.: 85,433

[22] Filed: Aug. 12, 1987

[51] Int. Cl.[4] ..... F41H 5/12

[52] U.S. Cl. ..... 89/36.07; 102/303; 109/22; 109/49.5

[58] Field of Search ..... 102/303; 89/36.04, 36.07, 89/36.13; 109/22, 49.5

[56] References Cited

U.S. PATENT DOCUMENTS

| | | | |
|---|---|---|---|
| 1,246,228 | 11/1917 | Bradshaw | 89/36.07 |
| 1,466,669 | 3/1923 | Martinson | 89/36.07 X |
| 2,317,392 | 4/1943 | Lord | 89/36.07 |
| 3,601,935 | 8/1971 | Cadwell | 89/36.04 |
| 3,641,638 | 2/1972 | Laible | 28/2 |
| 3,745,938 | 7/1973 | Hathaway | 109/2 |
| 3,762,345 | 10/1973 | Sgariglia, Jr. . | |
| 3,814,016 | 6/1974 | Leach et al. | 102/303 |
| 3,848,547 | 11/1974 | Schaefer . | |
| 4,412,495 | 11/1983 | Sankar | 109/2 |
| 4,510,200 | 4/1985 | Samowich | 428/2 |
| 4,546,863 | 10/1985 | Kaufman | 190/109 |
| 4,589,341 | 5/1986 | Clark et al. | 102/303 |
| 4,608,717 | 9/1986 | Dunbavand | 2/468 |

FOREIGN PATENT DOCUMENTS

| | | | |
|---|---|---|---|
| 494201 | 1/1917 | France | 89/36.07 |

*Primary Examiner*—Peter A. Nelson
*Attorney, Agent, or Firm*—Townsend & Townsend

[57] ABSTRACT

A full length, inflatable body shield or bulletproof mattress which can be carried in portable fashion in a stored condition within a relatively small case having a source of pressurized gas. A valve is provided to open the gas source to inflate the mattress stored in a collapsed condition in the case. In one embodiment, the mattress is carried in a case which has the appearance of a conventional briefcase. The case can be opened by an electronic system or manual backup system operated by the switches near the handle of the case. In another embodiment, the mattress is carried in a case which appears to be a backpack. The backpack is opened by pulling the clip when it is desired to inflate and use the mattress.

16 Claims, 3 Drawing Sheets

FIG. 6
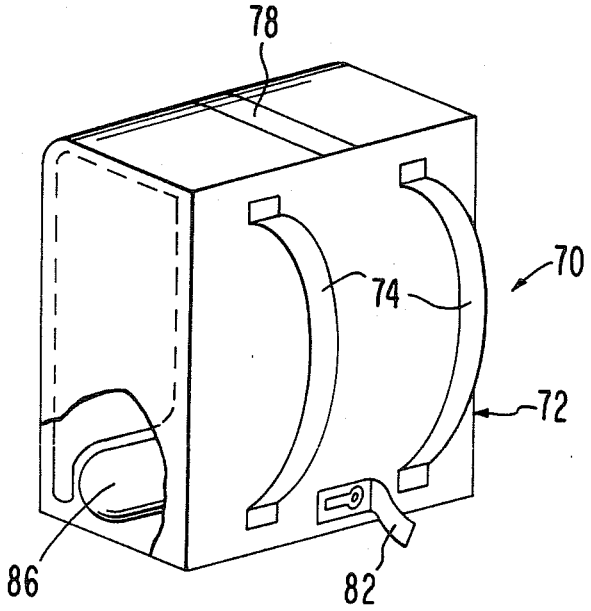
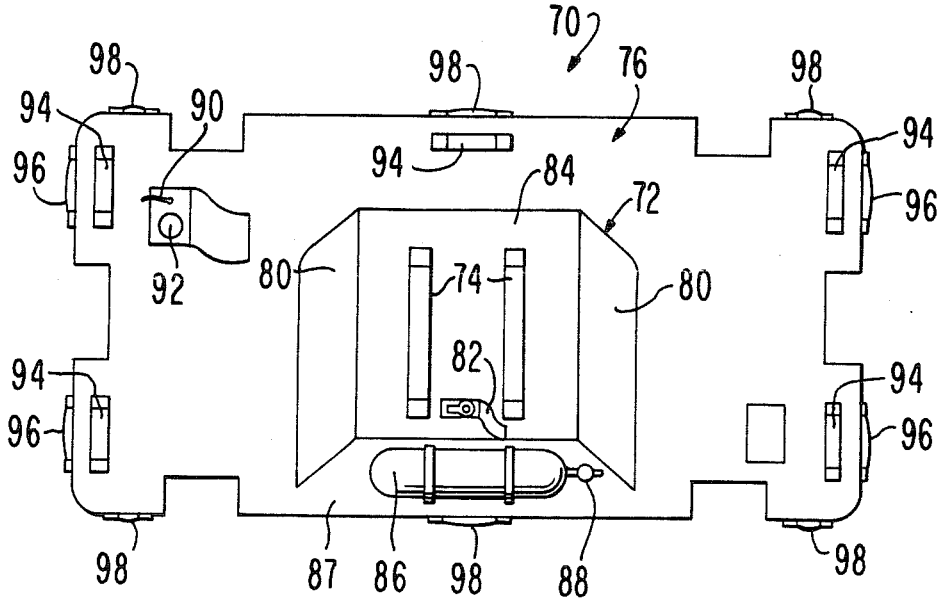
FIG. 7

BULLETPROOF PROTECTION APPARATUS

This invention relates to improvements in shields for the body to protect against gunshot wounds and, more particularly, to an apparatus for presenting an inflatable shield or mattress which will stop bullets fired from a weapon.

BACKGROUND OF THE INVENTION:

Body shields for protecting the human body against injury due to gunshot wounds have been known and used in the past. Even shield initially carried in portable fashion cases for rapid deployment have been known. Typical disclosures showing shields of the this type include the following U.S. Pat. Nos.: 1,466,669, 3,641,638, 3,745,938, 3,762,345, 3,848,547, 4,510,200 and 4,546,863.

For the most part, these shields have generally been satisfactory in specific circumstances; however, they have been not completely satisfactory in cases where rapid deployment of a full length body shield is needed. The need for rapid deployment of such a shield oftentimes arises in emergency situations where it is necessary to take immediate action to protect oneself against gunshot wounds while taking offensive actions, such as returning fire with a handgun while holding on to the shield. Because of these drawbacks, a need has arisen for improvement in portable human body shields to accomodate these situations. The present invention satisfies this need.

SUMMARY OF THE INVENTION:

The present invention includes a full length, inflatable body shield or bulletproof mattress which can be carried in portable fashion in a stored condition within a relatively small case which also includes a source of pressurized gas. Means is provided to open the pressurized gas source to admit pressurized gas into the mattress in a collapsed position so that the mattress can be quickly inflated to a full length condition. In an inflated condition, the mattress is of a size which can protect one or two persons behind it yet each or both of the persons can fire weapons from behind the mattress while holding on to the mattress and keeping it in an upright position.

Several embodiments of the mattress can be provided. In one embodiment, the mattress can be carried in a case which has the appearance of a conventional briefcase. The case can be opened by an electronic latch operated by a switch near the handle of the case, the case being coupled to the mattress at all times so that, when the use of the mattress is completed, the mattress can be collapsed and once again stored in the case. In this way, the mattress can be used over and over again with substantially no change in the operation or the structure of the mattress in the case.

In another embodiment of the invention, the mattress is carried in a case which appears to be a backpack. Means is provided to open the backpack when it is desired to inflate and use the mattress, whereupon the mattress can be returned to a collapsed condition and stored in the backpack/case until ready for use again.

The primary object of the present invention is to provide an improved apparatus for forming an inflatable body shield or mattress capable of being inflated on a moment's notice and which can be stored in a case which appears to be a briefcase or a backpack yet the shield or mattress can be quickly and easily inflated by compressed air from a source carried in the case or the backpack yet the use of the shield or mattress can permit the user to return fire with a weapon while holding on to the shield or mattress.

Other objects of this invention will become apparent as the following specification progresses, reference being had to the accompanying drawings for an illustration of the invention.

IN THE DRAWINGS

FIG. 6 is a second embodiment of the apparatus of the present invention, showing the inflatable mattress in its collapsed condition in a case in the form of a backpack; and FIG. 7 is a view similar to FIG. 5 but illustrating the mattress and case of FIG. 6, with the mattress in its inflated condition.

Figure 1:
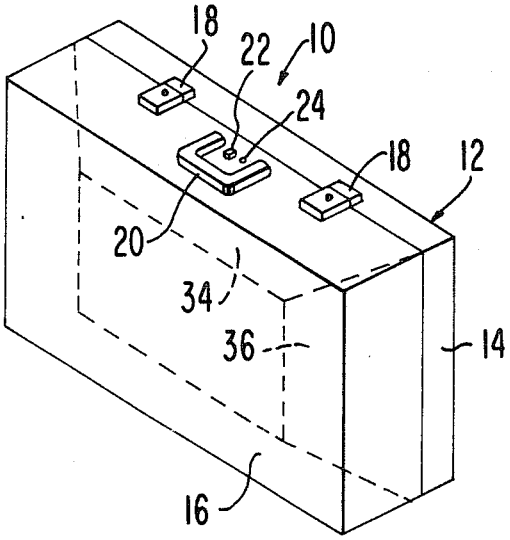
FIG. 1 is a perspective view of a first embodiment of the case forming one part of the bulletproof protection apparatus of the present invention.

The first embodiment of the bulletproof protection apparatus of the present invention is broadly denoted by the numeral 10 and is shown in FIGS. 1–5. Apparatus 10 includes a case 12 which appears to be a briefcase of conventional size and construction. The case has a top part 14 and a bottom part 16. A pair of hinge members 18 are provided on one side of the case. The hinge members 18 appear to be locking latches but, in reality, they are hinges which allow top part 14 to pivot away from lower part 16 in the manner shown in FIGS. 1 and 2.

Hinge members 18 are on opposite sides of a v-shaped handle 20 which is pivotally mounted at its ends on one side of lower part 16, and the handle has segments on opposite sides of a pair buttons 22 (electronic control) and 24 (manual backup system). Button 22 is electrically coupled to electrical circuitry having a test light. When the test light appears on button 22, it indicates that the circuitry is in working order. The buttons 22 and 24 are depressed to operate latch comprised of two elements 25 and 27 which can be interconnected when the case is closed. When one or the other button 22 or 24 is depressed, it operates a switch which unlocks the latch and allows parts 14 and 16 to separate and open the case. By depressing button 22 or 24, a valve is operated to cause inflation of a mattress as hereinafter described.

Figure 2:
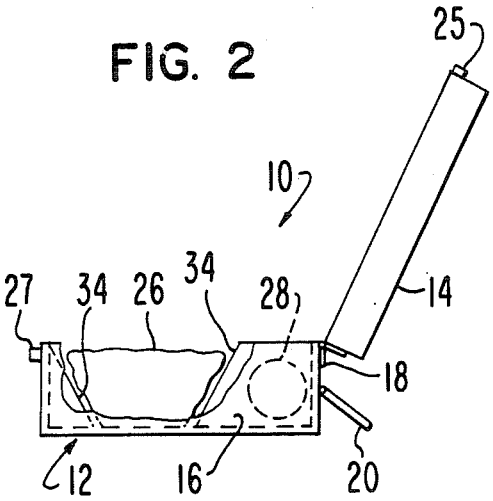
FIG. 2 is a side elevational view, partly broken away, of the case of FIG. 1, showing a bulletproof, inflatable mattress in a collapsed condition in the case.
Figure 3:
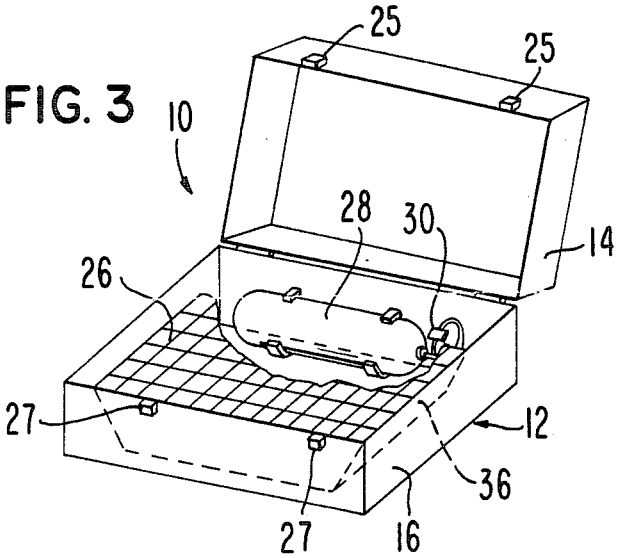
FIG. 3 is a perspective view of the case in an open condition, showing the mattress in its collapsed condition adjacent to a compressed air bottle.
Figure 4:
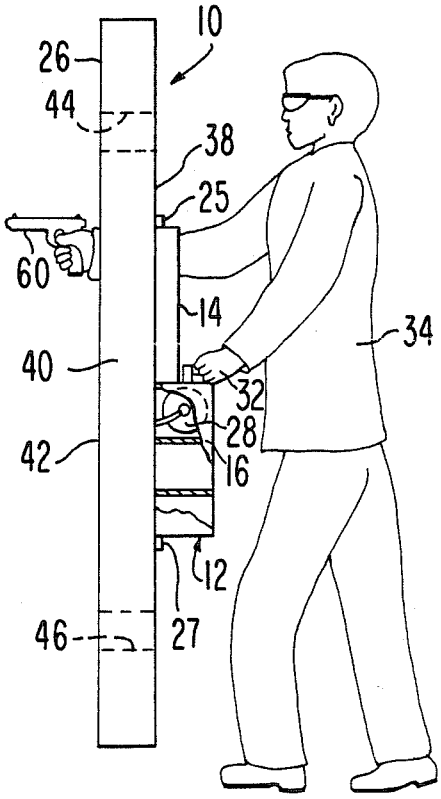
FIG. 4 is a side elevational view of the apparatus with the mattress inflated and in use by a person holding the handle of the case behind the mattress.
Figure 5:
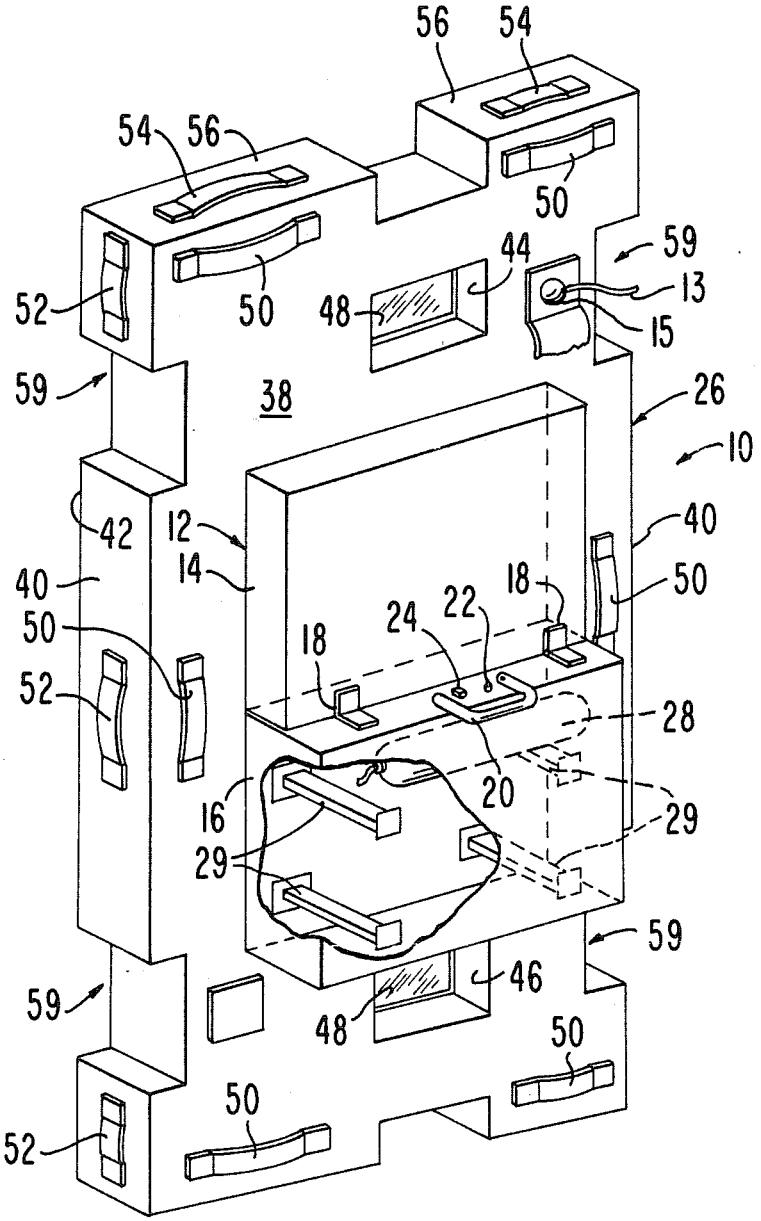
FIG. 5 is a perspective view of the mattress looking at the rear thereof, when the mattress is inflated.

An inflatable bulletproof shield or mattress 26 is carried in a collapsed condition in lower part 16 of case 12 in the manner shown in FIGS. 2 and 3. A bottle 28 of compressed gas, such as air or $CO_2$, is also carried within lower part 16 of case 12 and is coupled with a valve 30 to the mattress. Valve 30, when opened, allows the pressurized gas from bottle 28 to inflate mattress 26 rapidly. As the mattress is inflated, it assumes the operative condition shown in FIGS. 4 and 5 in which the mattress forces the upper part 14 of case 12 to extend upwardly from one side of lower part 16 as shown in FIGS. 4 and 5. The handle 20 is in position to be engaged by the hand 32 of the person 34 using apparatus 10 as a protective shield. When fully inflated, mattress 26 provides a bulletproof shield which will protect one or two persons from firearm assaults.

As shown in FIGS. 1 and 2, case 12 has slanted or inclined side and end surfaces 34 and 36 within part 16 thereof. These surfaces permit the mattress to spring out quickly and easily when the mattress is inflated by the pressurized gas from bottle 28.

Mattress 26 is made of a material resistant to puncture from bullets fired from guns. The mattress 26 has a rear face 38 (FIG. 5) a pair of side faces 40, and a front face 42 (FIG. 4). The mattress has viewing holes 44 and 46 near the upper and lower ends thereof, each viewing hole having a bulletproof glass pane 48 across the opening. Strap handles 50 are provided on the top, sides and bottom of rear face 38; straps 52 are provided on sides 40; and straps 54 are placed on top surface segments 56 as shown in FIG. 5.

Sides 40 are provided with openings or recesses 59. The openings or recesses are small enough to enable protection but large enough for the user of the apparatus 10 to place the hand or arm in the opening to allow the user to assume a shooting stance as shown in FIG. 4 wherein the pistol 60 held by the user is slightly forwardly of the mattress 26. The portion of the mattress adjacent to the opening 59 can be used as a lever to reduce the jolt from the firearm for a better aim and greater marksmanship.

Handle 20 is designed so that the user can shoot and move with protection toward an intruder or into a safer location at the same time, similar to holding on to a shield. The mattress 26 is secured by four flexible straps 29 to connect the inner surface of lower part 16 of case 12 as shown in FIG. 5. These straps flex and retract into the case when the mattress is deflated so that the mattress can again be placed in the lower part 16 of case 12 as shown in FIGS. 2 and 3.

A tube 13 may be provided to manually inflate mattress 26, if necessary. A valve 15 can also be provided near tube 13 and quickly opened to serve as an emergency valve to rapidly deflate the mattress if necessary.

In use, case 12 is typically in the closed condition shown in FIG. 1. When it is desired to use apparatus 10, button 22 or 24 is depressed, unlocking the latch of the case and opening valve 30, causing compressed gas to rush into collapsed mattress 26, inflating the mattress into its operative condition shown in FIGS. 4 and 5. The mattress can continue to be held by handle 20 or can be held by any of handles 50 or 52. When it is desired to deflate the mattress, valve 15 can be opened, allowing a rush of compressed gas out of the mattress to deflate the same and allow the mattress to be placed in a stored condition again in the case as shown in FIGS. 2 and 3.

A second embodiment of the apparatus of the present invention is denoted by the numeral 70 and includes a case 72 in the form of a backpack having straps 74 for carrying the case 72 in the manner of a backpack. An inflatable mattress 76 is within the case 72 and the case can be opened by pulling the clip 82 which allows the Velcro or other fasteners 78 to separate to permit the sides 80 of the case to swing away from the condition in which the sides 80 form case 72 with back panel 84. The back panel is secured in some suitable manner to a mattress 76, such as by stitching or straps. A bottle 86 containing pressurized gas is carried by a bottom panel 86 of case 72 and is coupled by a valve 88 which, when actuated and opened by pulling clip 82, allows pressurized gas to rush into mattress 76 to quickly and immediately inflate the same. Straps 74 can be used to support the mattress in an upright condition similar to the position of the mattress as shown in FIGS. 4 and 5.

Mattress 76 has a tube 90 for manually inflating the mattress. Also, a quick purge valve 92 is provided for use when it is desired to quickly and rapidly deflate the mattress. Handles 94 are provided on the rear face of mattress 76, straps 98 are provided on the sides and handles 96 are provided on the upper and lower surface portions of the mattress as shown in FIG. 7.

Mattress 76 when inflated gives temporary protection to the serviceman in the open field where danger occurs; gives protection to the serviceman in order to get to the wounded under fire and also serves as a cot in military and other uses to carry wounded individuals. Also, mattress 76 is designed to float on water so that it can be used as a life raft.

What is claimed is:

1. Bulletproof protection apparatus comprising:

a case capable of being opened and closed; a collapsible, inflatable shield; means coupling the shield to the case, the shield being of a size sufficient to allow the shield to be contained in the case in its collapsed condition when the case is closed; and means carried by the case for inflating the shield when the case is opened.

2. Apparatus as set forth in claim 1, wherein said inflating means includes a source of pressurized gas carried by the case.

3. Apparatus as set forth in claim 1, wherein said inflating means includes a source of pressurized gas, valve means coupled with said source, and electrical circuitry coupled with the valve for selectively operating the valve to cause pressurized gas from the source to enter the shield to inflate the shield.

4. Apparatus as set forth in claim 1, wherein said shield comprises a bulletproof mattress having front and rear walls capable of deflecting a bullet shot from a gun.

5. Apparatus as set forth in claim 4, wherein is included a viewing port through the mattress, said viewing port being covered by a transparent bulletproof window.

6. Apparatus as set forth in claim 5, wherein the mattress has a number of handles thereon for permitting the mattress to be hand held.

7. Apparatus as set forth in claim 5, wherein the mattress has a side opening for permitting access to the hands and arms of the user to allow the firing of a handgun from one side of the mattress.

8. Apparatus as set forth in claim 5, wherein the length of the mattress is sufficient to fully shield a person of average height behind the mattress.

9. Apparatus as set forth in claim 1, wherein the case comprises a first part and a second part, and hinge means interconnecting the parts.

10. Apparatus as set forth in claim 9, wherein the case has a handle adjacent to the hinge, means there being a latch on the side of the case remote from the hinge means.

11. Apparatus as set forth in claim 10, wherein the latch is electrically actuated.

12. Apparatus as set forth in claim 10, wherein is included circuitry carried by the case and coupled with the latch for operating the latch to allow opening of the case.

13. Apparatus as set forth in claim 1, wherein said coupling means includes a number of flexible straps coupled to the case and to the shield.

14. Apparatus as set forth in claim 10, wherein the case has an internal space and a number of inclined surfaces in said space, said shield being engageable with the surfaces to enhance the expansion of the shield when the shield is inflated and when the case is open.

15. Apparatus as set forth in claim 1, wherein the case is in the form of a briefcase.

16. Apparatus as set forth in claim 1, wherein the case is in the form of a backpack

* * * * *